United States Patent [19]

Sakai et al.

[11] Patent Number: 4,806,153

[45] Date of Patent: Feb. 21, 1989

[54] METHOD AND APPARATUS FOR INVESTIGATING SUBSURFACE CONDITIONS

[75] Inventors: Katsuo Sakai, Kawasaki; Tadahiko Muromachi, Kokubunji; Yukio Sakai, Komae, all of Japan

[73] Assignee: Kisojiban Consultants Co., Ltd., Tokyo, Japan

[21] Appl. No.: 20,155

[22] Filed: Feb. 25, 1987

Related U.S. Application Data

[63] Continuation of Ser. No. 797,536, Nov. 13, 1985, abandoned, which is a continuation of Ser. No. 518,524, Jul. 29, 1983, abandoned, which is a continuation-in-part of Ser. No. 331,461, Dec. 16, 1981, abandoned.

[30] Foreign Application Priority Data

Jan. 22, 1981 [JP] Japan ..... 56-8361

[51] Int. Cl.[4] ..... E21B 47/00

[52] U.S. Cl. ..... 73/151; 175/50

[58] Field of Search ..... 73/38, 40, 73, 84, 151, 73/154; 340/853; 367/33; 175/50; 364/420, 422

[56] References Cited

U.S. PATENT DOCUMENTS

| | | | |
|---|---|---|---|
| 3,149,683 | 9/1964 | Clements et al. | 175/50 |
| 3,700,049 | 10/1972 | Tiraspolsky et al. | 175/50 |
| 3,906,781 | 9/1975 | Vlasblom | 73/84 |
| 4,033,186 | 7/1977 | Bresie | 73/154 |
| 4,161,782 | 7/1979 | McCracken | 73/154 X |
| 4,195,349 | 3/1980 | Balkanli | 73/154 X |
| 4,332,160 | 6/1982 | Baragar et al. | 73/84 |

FOREIGN PATENT DOCUMENTS 0056872 3/1985 European Pat. Off. .

*Primary Examiner*—Joseph A. Orsino Jr.
*Assistant Examiner*—Brian R. Tumm
*Attorney, Agent, or Firm*—Armstron, Nikaido, Marmelstein & Kubovcik

[57] ABSTRACT

A method and apparatus for investigating subsurface ground of a site to obtain and store information about soil conditions by pushing into the ground a cableless unit that includes a memory storage device able to collect the information throughout the whole investigation process. After completion of the process, the memory storage device is lifted up to the surface of the ground and is connected to a data processing unit located on the ground to extract the collected information on soil conditions.

2 Claims, 4 Drawing Sheets

METHOD AND APPARATUS FOR INVESTIGATING SUBSURFACE CONDITIONS

This application is a continuation of application Ser. No. 797,536, filed Nov. 13, 1985, now abandoned, which is a continuation of Ser. No. 518,524, filed July 29, 1983, abandoned, which is a continuation-in-part of Ser. No. 331,461, filed Dec. 16, 1981, abandoned.

DETAILED DESCRIPTION OF THE INVENTION:

The present invention relates to a method of investigating subsurface ground conditions, and a cableless subsurface investigating apparatus that has memory storage.

A number of investigation methods have been used for investigating subsurface conditions. Methods for investigating the subsurface include the standard penetration test, cone penetration tests of varied kinds, the Swedish sounding test, vane tests, etc.

These tests are all carried out by inserting a sensing body into the ground by impact, thrusting, rotation, etc. The sensing body is generally attached to the fore end of a rod. The number of impacts made, force of thrusting pressure, torque of rotation, and the like, all being applied at the other end of the rod, are measured, together with the extent of penetration and the angle of rotation. Likewise, information about the subsurface ground conditions obtained by the sensing body attached to the fore end of the rod is transmitted up to the surface of the ground via a rod serving as an information transmitting medium.

The systems described above necessitate differentiation of the ground information collected by the probe from the effects of frictional resistance that develops between the rod and the soil and which increases as the rod goes deeper underground. To lessen the friction, therefore, various contrivances and techniques have been introduced including the use of a rod having a diameter less than that of the sensing part, use of a water jet to reduce friction at the rod portion of the apparatus body, pushing the sensing part into the ground in a prebored hole, use of double rods, etc. In addition to these, to achieve higher degrees of data precision and acquire automatic recording capability, another system has been put into practice. In this case, an electric converter is provided either within a sensing probe or connected thereto so that subsurface ground information is converted into an electrical signal and, with a cable employed as an information transmitting medium, the signal is transmitted for recording to the surface of the ground (Japanese Patent Publication No. 46-1498). Using this cable method, an attempt has recently been made to measure water pressure in soil (pore-water pressure), to detect the sound of soil particle friction resulting from the penetration process, and to measure the specific electrical resistance of soil.

However, since a cable is used as an information transmitting medium in each of the above methods, work is carried out under many restrictions and also trouble such as cable breakage is often encountered when a sensing probe is inserted deep into the soil. To solve such problems, various methods have been attempted including a method of arranging the rod and cable into an unified body, and another method in which ground information is converted into elastic waves and transmitted to the ground surface through casing pipes used during boring (Japanese Patent Publication No. 53-11774). However, these methods have not been put into practice as of yet because of drawbacks such as excessive noise, etc.

The present invention is directed at the solution of these problems in the prior art. It is, therefore, an objective of the invention to provide a method and an apparatus whereby these problems can be solved. In this new invention, a subsurface ground information sensor unit that is inserted deep into the soil, and a memory and control device for automatically recording subsurface data and information, which has hithereto been recorded on the surface of the ground, are unified into a subsurface information collector unit. The subsurface information collector unit is inserted into the ground by means of driving, pushing or rotating motions or a combination of these provided by ordinary boring machines. The subsurface information thus obtained by the sensor is immediately and successively stored in the memory and control device within the collector unit. Upon completion of the intended subsurface investigation, the subsurface information collector unit is pulled up to the surface of the ground. The memory and control device is then connected to a data processing device containing a micro-computer deployed on the ground. The data stored in the information collector unit is thus extracted by the data processing device. Then, analysis of the ground information is carried out through computation, tabulation, charting, etc. by the said micro-computer. The method provided by the invention makes the whole subsurface ground investigation system efficient to attain the desired end.

In conventional subsurface investigation systems, the sensor that is in contact with the soil and that measures various engineering characteristics of the soil is invariably underground while the controllers, information displays, storage units, and recording devices are separately deployed above the ground. Cables, rods, pipes, etc. are used to connect the device in the ground with those above. In the case of the present invention, the ground information sensors and the memory and control device are combined into one unit which is inserted into the ground. This arrangement obviates the necessity of using cables, rods, or pipes to transmit information to the surface of the ground. This is an important feature of the invention.

Without the necessity of using the cables, etc. for information transmitting mediums as is the case with the present invention, the following advantages are derived: firstly, the trouble associated with the information transmitting medium system is eliminated. Secondly, the way of forcing the ground information sensor into the ground is diversified. In other words, with the conventional systems the ground information sensor is either dynamically or statically introduced into the ground. Then, when it becomes physically impossible to push the sensor into ground at depth, the sensor is raised and a hole larger in diameter than the sensor is drilled to the last measurement depth. Then, the drill string is raised and the sensor is lowered into the hole, at which time the subsurface investigation is continued. However, in the case of the present invention, the ground information sensor can be successively forced into the ground during the boring operation without raising the drill string to the surface of the ground until completion of the investigation at one particular point of the site. This becomes possible since with the present invention a drilling system or earth cutting mechanism can easily be combined with the ground information collector unit as the latter includes no cable which would interfere with borehole advancement systems. One of many practical advantages of this invention is that the unit can be combined with a rotary boring machine to greatly reduce frictional resistance between the soil and the rod. Therefore, even when measurements must be taken in deep ground, the invention permits to a great extent reduction in the capacity of the facility required for reaction and that of the device required for pressure insertion. This is an economic advantage. In addition, this new invention can be freely transported to survey sites that heretofore have inhibited the use of larger conventional apparatuses. With the invented apparatus, therefore, any desired ground can be investigated.

The subsurface information that can be obtained by the ground information sensor according to the invention includes the strength parameter of ground (tip penetration resistance) and pore-water pressure. From these, coefficient of permeability and parameters of coefficient of consolidation of ground are obtainable. The information obtainable further includes earth pressure in a horizontal direction (the coefficient of earth pressure at rest), frictional strength of soil, and if necessary, parameters that reflect water content of soil (such as specific electrical resistance, electrostatic capacity, and the intensity of neutron transmission), frictional sounds (for determining the type of the soil, etc.), corrosion, thermal properties, etc. Recording of the ground information at the memory and control device may be made using an IC memory or a magnetic recording tape.

The present invention will be more fully understood from the following detailed description and accompanying drawings. It should be noted that FIGS. 1 through 4 describe only one of many shapes and orientations. feasible using the method stated below, wherein:

BRIEF DESCRIPTION OF THE DRAWINGS

In FIG. 5, (a) shows the soil formation of a ground to be investigated, (b) shows the time sequence of the subsurface investigation, and (c) shows the penetration force measured verses depth.

Referring to FIG. 1 which schematically shows the entire layout of the subsurface investigation system, a ground information collector (2) which has a ground information sensor (2*a*) and a memory and control device (2*b*) combined into one unified body therein is attached to the fore end of a boring rod (1). This rod (1) with the information collector (2) is either continuously or intermittently forced into the ground by a combination of downward thrust provided by a hydraulic jack (3) and rotation by a hydraulic motor (4). The downward thrust and rate of downward movement of the hydraulic jack (3) is controlled by a controller (5). The rotation by the hydraulic motor (4) is controlled by a rotation controller (6). Reference number 7 indicates a hydraulic pump and number 8 indicates a mud water pump. The mud water pump (8) is arranged to send drilling mud water to the inside of the rod (1) through a hose (9) and a water swivel (10). A boring operation is arranged in this manner. The reaction to counter-balance the downward thrust of the jack (3) is provided by a screw anchor (11). A data processing unit (12) is arranged such that it will continuously monitor the movement of the probe (2) through the rod movement.

Figure 1:
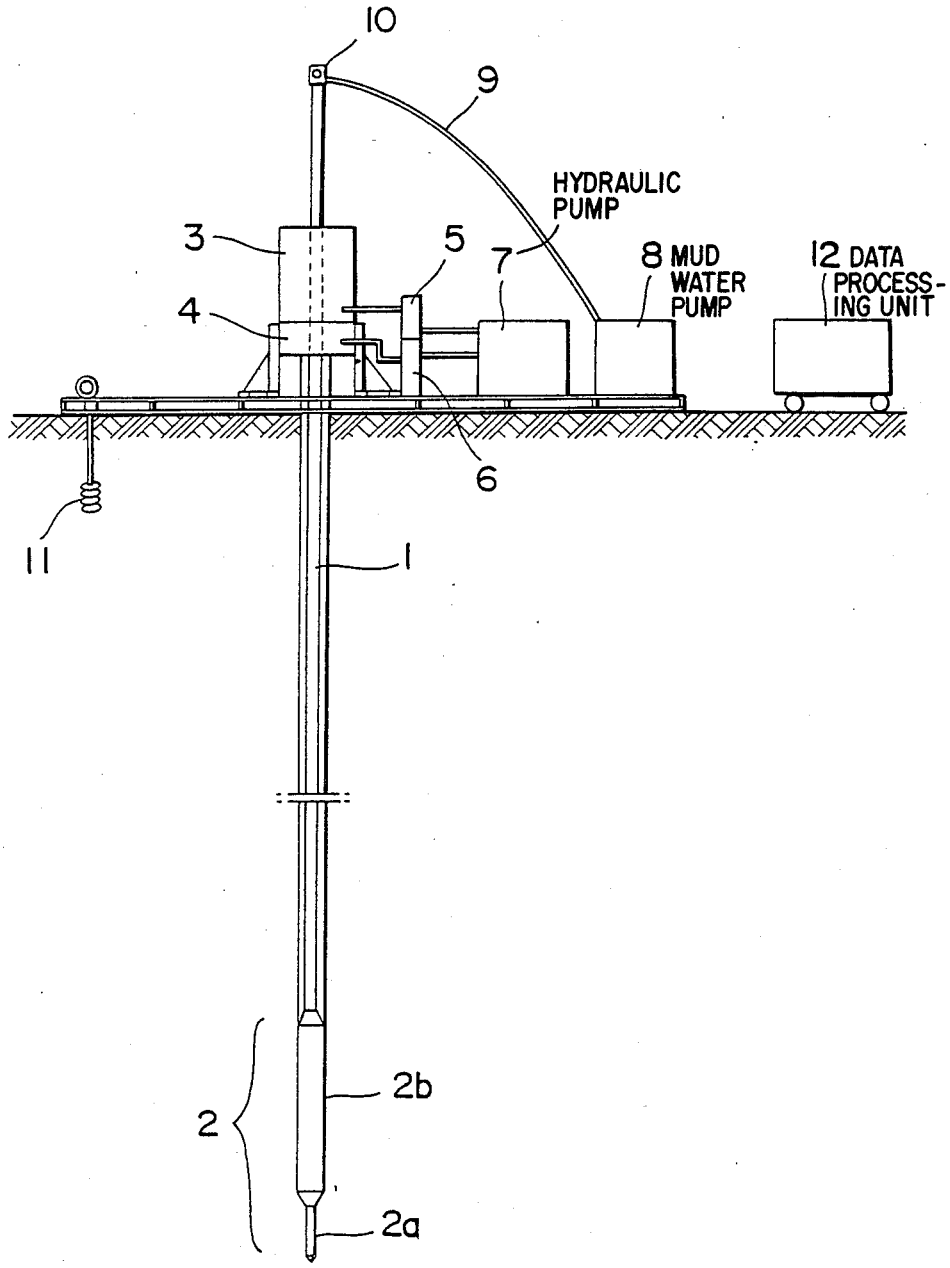
FIG. 1 is a schematic view showing an entire subsurface ground investigation apparatus as a preferred embodiment of the invention.
Figure 2:
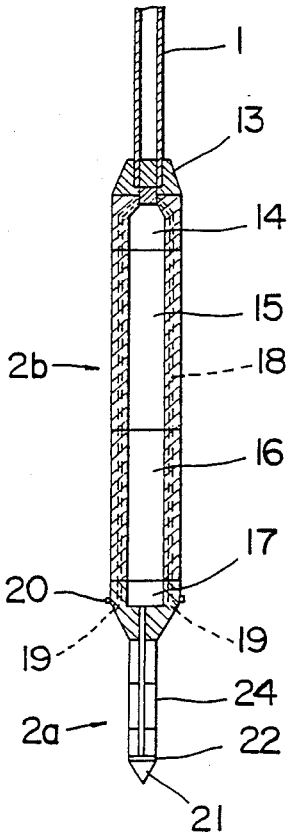
FIG. 2 is a sectional view showing the memory and control device included in the ground information collector of the apparatus.

The details of the above-stated ground information collector (2) and particularly those of the memory and control devices (2*b*) of the collector (2) are shown in FIG. 2. The memory and control device (2*b*) is comprised of: a head (13) which is attached to the lower end of the rod (1); a connector chamber (14) which is arranged adjacent to the head (13) for extracting information; a memory storage unit (15); a control device (16); and a connector chamber (17) which is provided for connecting the ground information sensor (2*a*) to the lower end of the memory and control device (2*b*). Within the outer shell of the collector (2), there are longitudinal water lines (18), which open at the connector chamber (17) in the form of jet nozzles (19). In close vicinity to the jet nozzles (19), cutting tips (20) are provided.

Figure 3:
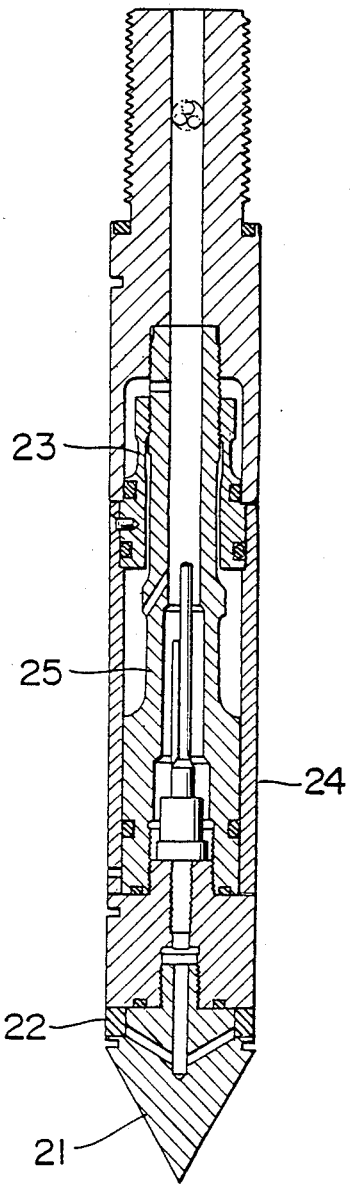
FIG. 3 is a sectional view showing the ground information sensor of the same apparatus.

The ground information sensor (2*a*) is provided with a cone (21) which is located at the fore end of the sensor; a water pressure measuring part (22) which measures pore-water pressure and is situated adjacent to the cone; and a friction measuring part (24) having a circumferential friction measuring cell (23), the friction measuring part (24) being located above the water pressure measuring part (22). Details of the sensor (2*a*) are shown in FIG. 3. The sensor (2*a*) is further provided with a connecting rod (25) for pushing the cone into the ground.

Figure 4:
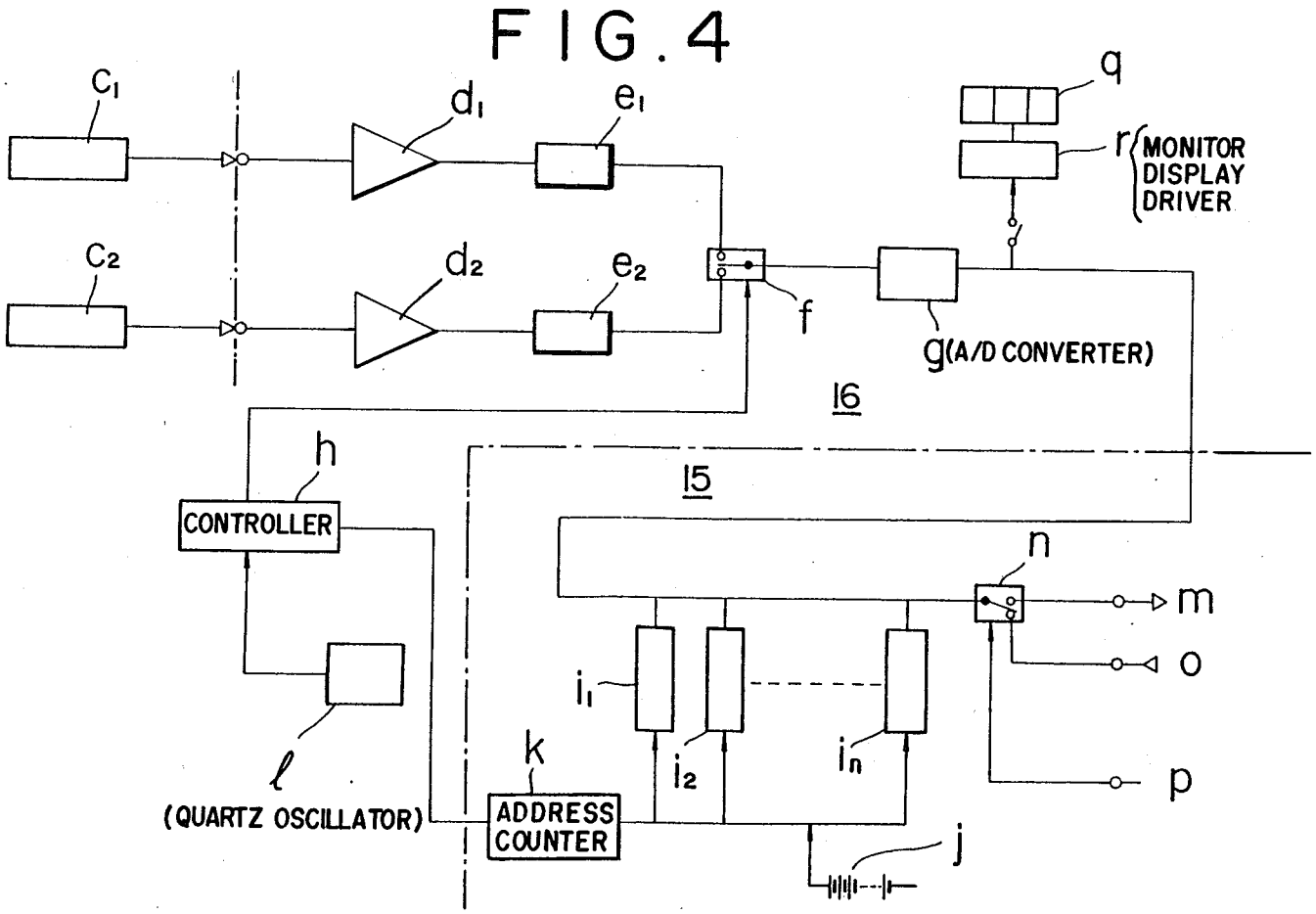
FIG. 4 is a block diagram showing the operation of the memory and control device shown in FIG. 2.

The operation of the memory storage (15) and the control device (16) of the ground information collector (2) pushed into the ground is shown in the block diagram found in FIG. 4. The ground information sensor (2*a*) contains sensor elements ($c_1$, $c_2$, . . . ,) arranged to provide information about the ground. The ground information thus obtained enters the control device (16) in the memory and control device (2*b*). The information goes through amplifiers ($d_1d_2$, . . . ,), peak holds ($e_1$, $e_2$, . . . ,), a multiplexer (f), and an A/D converter (g) before reaching the memory storage (15). Further, a controller (h) is provided for control over the multiplexer (f) and the memory storage (15).

In the memory storage (15), memories ($i_1$, $i_2$, . . . ,), a memory back-up battery (j), and a quartz oscillator (l) that performs timing for the controller (h) are provided. In response to an instruction from the controller (h), an address counter (k) locates an appropriate memory (i), i.e. selects one of the memories $i_1$, $i_2$, . . . , $i_n$ to store the ground information recorded. The ground information detected by the ground information sensor (2*a*) is automatically recorded in this manner at each of the memories ($i_1$, $i_2$, ... $i_n$) so as to have the information divided and stored in them. Upon completion of the investigation, the ground information collector (2) is raised to the surface of the ground. The collector (2) is removed from the rod (1). Then, the data processing device (12) is connected to the connector chamber (14) to extract the information. The information recorded and stored in the memory in 2*b*is thus taken out by the device (12) and is read out by a digital read-out arrangement (m).

Further, if necessary a digital write-in (o) or a read-and-write control signal (p) may be fed into the memory (i) from the data processing device through a selector switch (n). Reference letter q indicates a monitor display in the control device (16), and r indicates a driver for the monitor display (q).

Figure 5:
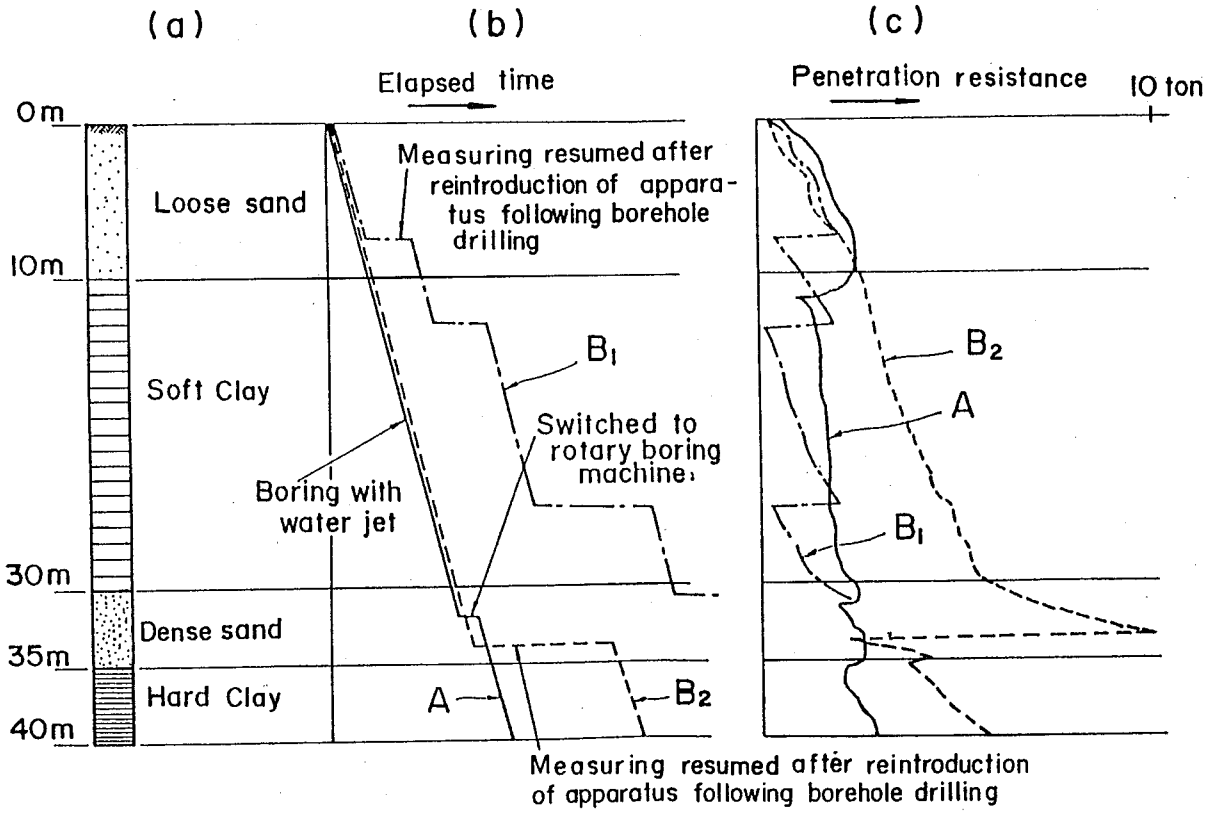
FIG. 5 is an illustration comparing examples of measurement work performed with the invented apparatus and with a conventional apparatus.

Measuring work performed by the apparatus according to the invention is compared in FIG. 5 with that performed using 2-ton and 10-ton Dutch cone tests in accordance with Japanese Industrial Standard A 1220.

Referring to FIG. 5, the ground information sensor shown in FIG. 3 was used to represent the present invention, and the results are shown by solid curve A. Results of the measurements obtained by the present invention compare favorably not only with curve $B_1$ representing the conventional 2-ton Dutch cone test but also with curve $B_2$ representing the conventional 10-ton Dutch cone test. This is true in both the efficiency account shown in (b) and in the penetration resistance shown in (c).

Further, the length of time required for placing anchors and installing the machine before beginning the penetration work was 0.5 days for system A, 0.5 days for system $B_1$, and 1.5 days in the case of system $B_2$. This indicates that the present invention is advantageous also in this respect.

What is claimed is:

1. A method for investigating subsurface ground conditions and collecting data and information relating thereto comprising:

(a) lowering a recording and control unit of a down hole, in situ soil testing device having preselected individual sensors, data acquisition rates and activation times; said device comprising:

(1) a sensor unit comprising said sensors capable of continuously sensing a plurality of physical soil parameter including a measurement of the force resisting tip penetration, the lateral soil frictional force resisting penetration, and the pore water pressure in the soil at the depth of penetration;

(2) said recording and control unit which records in digital form the analog output of all the sensors in a preselected repetitive manner while the testing device is being penetrated into the ground; and (3) a power unit which supplies power to the previous two units;

(b) penetrating said down hole device into the ground;

(c) retrieving said device to the surface of the ground and transferring said data and information to a second memory device for permanent storage;

(d) processing said data and information in a desired form by computation, tabulation, and charting of said data.

2. An in situ soil testing device for measuring soil parameters while being forcibly penetrated into the soil comprising:

(a) a means for penetrating said device into the soil;

(b) said device including a plurality of sensors to collect data and information, means for recording in digital form data and information transmitted by the sensors, a power unit, the recording means having a control unit, said device including sensors to measure the forces resisting tip penetration, the lateral soil frictional forces resisting penetration, and the pore-water pressure in the soil at the depth of penetration;

(c) retrieval means for bringing said device to the surface;

(d) transfer means to transfer data and information to a memory device for permanent storage; and (e) processing means to process said data and information by computation, tabulation and charting of said data and information.

* * * * *